US007121349B2

(12) United States Patent
Jennings

(10) Patent No.: US 7,121,349 B2
(45) Date of Patent: Oct. 17, 2006

(54) WELLHEAD PROTECTOR

(75) Inventor: Charles E. Jennings, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 272 days.

(21) Appl. No.: 10/821,072

(22) Filed: Apr. 8, 2004

(65) Prior Publication Data

US 2004/0200622 A1 Oct. 14, 2004

Related U.S. Application Data

(60) Provisional application No. 60/461,745, filed on Apr. 10, 2003.

(51) Int. Cl.
*E21B 33/00* (2006.01)

(52) U.S. Cl. ..... 166/379; 166/241.1; 384/24

(58) Field of Classification Search ..... 166/379, 166/380, 241.1; 175/220; 384/24; 405/184.4
See application file for complete search history.

(56) References Cited

U.S. PATENT DOCUMENTS

| | | | | | |
|---|---|---|---|---|---|
| 1,485,308 | A | * | 2/1924 | Stegeman | 188/67 |
| 2,365,681 | A | * | 12/1944 | Gartin | 384/24 |
| 2,365,682 | A | * | 12/1944 | Curtis et al. | 384/24 |
| 4,326,756 | A | * | 4/1982 | Moroz et al. | 384/24 |
| 4,505,614 | A | * | 3/1985 | Anschutz | 405/195.1 |
| 6,615,921 | B1 | | 9/2003 | Whitelaw et al. | |

* cited by examiner

*Primary Examiner*—William Neuder
(74) *Attorney, Agent, or Firm*—Bracewell & Giuliani LLP

(57) ABSTRACT

A centralizer is located in a passage of a tubular body of a wellhead assembly for centralizing well tools lowered through the passage. Centralizing members have outer ends mounted to axially extending stationary hinge members, which are mounted to the tubular body in a circular array around a circumference of the passage. A cam and a slot are located between the outer end of each of the centralizing members and the stationary hinge member. Each of the slots has an upward inclined portion, a downward inclined portion, and a neutral position located between the upward and downward inclined portions. A spring urges the cam and the slot to the neutral position, which orients the centralizing members radially inward.

20 Claims, 5 Drawing Sheets

WELLHEAD PROTECTOR

This invention claims priority of provisional application Ser. No. 60/461,745, filed Apr. 10, 2003 entitled "Wellhead Protector".

FIELD OF THE INVENTION

This invention relates in general to a protective device for preventing damage to a wellhead from drill strings and other tools being lowered through the wellhead.

BACKGROUND OF THE INVENTION

In offshore well drilling operations, the operator must pass tools through remote well components that have surfaces specially prepared for eventual sealing with another well component. For example, the well component might be a wellhead housing having seal surfaces for a packoff of a casing hanger and possibly also a tubing hanger. During drilling, the drill bits and drill strings must pass through the wellhead housing, thus could damage the seal surfaces.

Normally, the operator installs a wear bushing over the seal surfaces in the wellhead housing. A wear bushing is a sleeve, normally metal, that is placed over the seal surfaces. Usually, the wear bushing is run on a running tool lowered on pipe, such as drill pipe. When the operator is ready to install the component in the seal surface or to change to a smaller drill bit size, he must retrieve the wear bushing. In deep water, the time to run and retrieve a wear bushing is very costly.

Wear bushings that are run in with the drill bit and retrieved with the drill bit are known and will reduce the cost of a trip but are not used extensively because of possible malfunctions. Also, once either type of wear bushing has been removed, there is no protection for the seal surface until the component has landed and sealed against the seal surface. For example, the lower end of the casing below a casing hanger could come into contact with the seal surface while the casing is being run. U.S. Pat. No. 6,691,921 shows a powered centralizer located above a wellhead housing for centering equipment being lowered through the wellhead housing. The system shown therein is not yet in use, and improvements are desirable.

SUMMARY OF THE INVENTION

The centralizer of this invention has a tubular body having an axis and a passage extending therethrough along the axis. A centralizer is mounted to the tubular body around the passage, the centralizer being movable between a restricted position and an unrestricted position in response to contact with a well tool moving through the passage. At least one spring that urges the centralizing member to the restricted position.

In the preferred embodiment, the centralizer comprises a set of centralizing members mounted to the tubular body around the passage. The centralizing members pivot between a restricted position and an unrestricted position in response to contact with a well tool moving through the passage. Springs bias the centralizing members to the restricted position.

The centralizing members protrude generally radially inward while in the restricted position and have inner ends that are spaced circumferentially apart from each other. Preferably, each centralizing member rotates about an axis parallel to the axis of the tubular body when moving between the restricted and unrestricted positions. In the preferred embodiment, the passage of the tubular member has an annular recess, and the centralizing members locate substantially within the recess while in the unrestricted position. Preferably, each of the centralizing members is in the shape of a paddle that is curved, when viewed in a cross-section perpendicular to the axis, at a radius that is substantially equal to a radius of the passage.

DETAILED DESCRIPTION OF THE INVENTION

Figure 1:
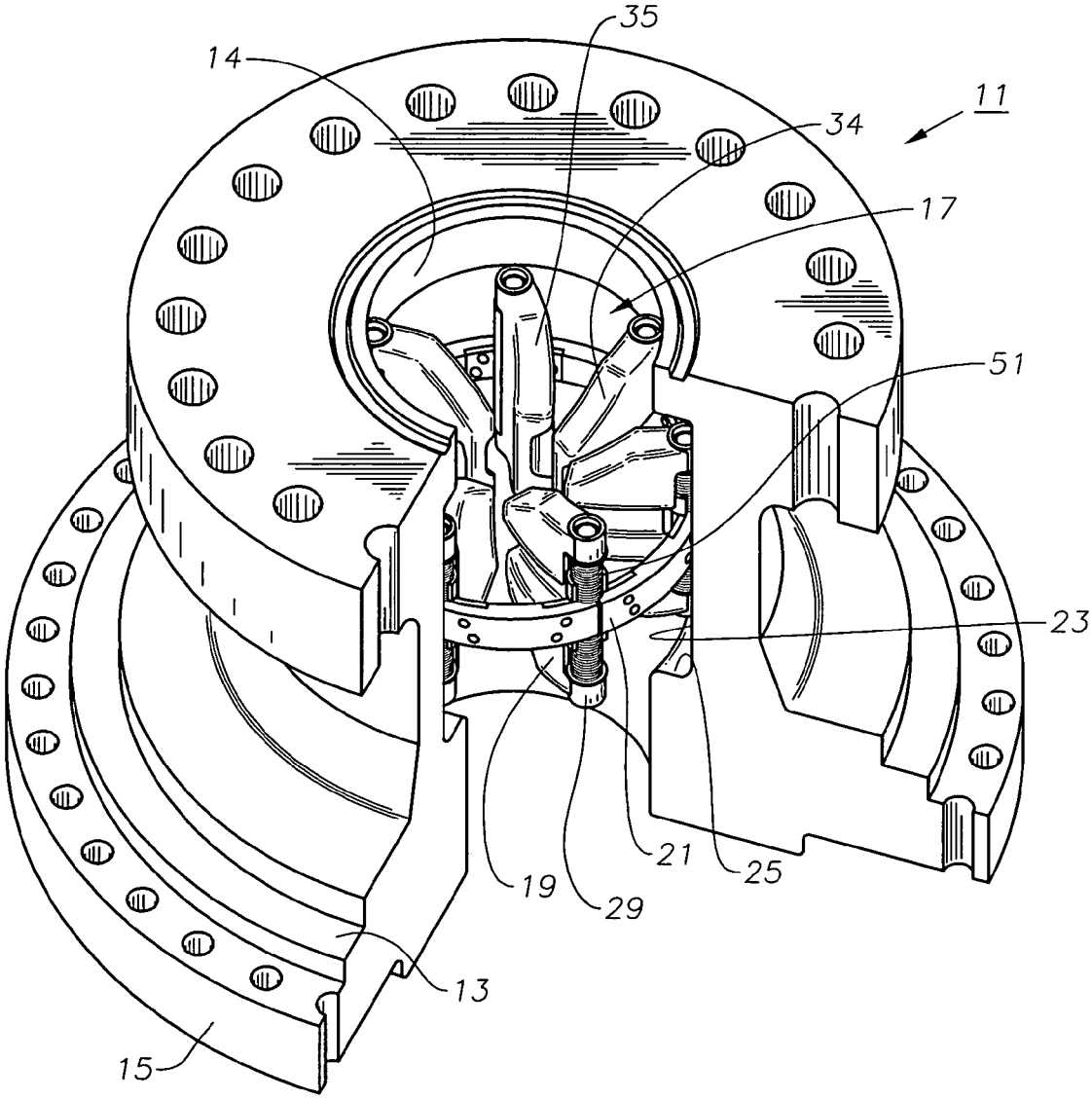
FIG. 1 is a perspective view, partially broken away, showing a wellhead protector in accordance with this invention.
Figure 2:
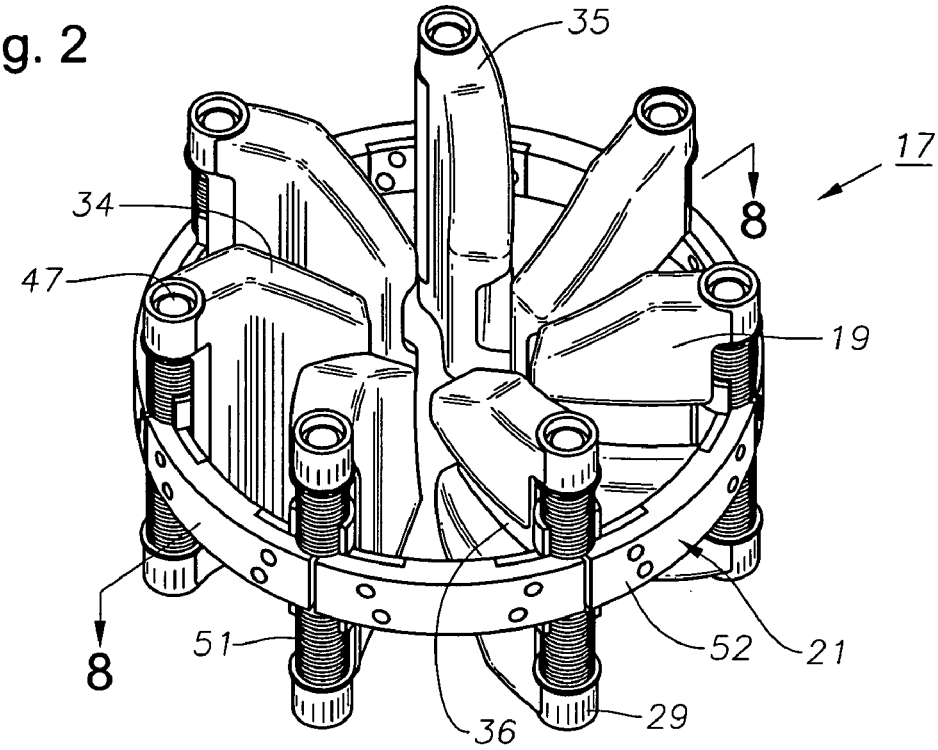
FIG. 2 is a perspective view of the centralizer of the wellhead protector of FIG. 11 shown removed and in a deployed position.

Referring to FIG. 1, wellhead protector 11 is mounted to a spool or body 13 that connects into a drilling riser string for subsea drilling operations. Body 13 is a tubular member having flanges 15 on its upper and lower ends and an axially extending bore 14. The lower flange 15 will bolt to a wellhead connector (not shown) for connecting to a wellhead housing or tree mandrel. The upper flange 15 connects to a lower portion of the drilling riser string.

A centralizer 17 is mounted in bore 14 of body 13. Centralizer 17 has a plurality of centralizing members or paddles 19 that extend generally radially inward while in the deployed position shown in FIG. 1. In the retracted position shown in FIG. 8, paddles 19 are approximately normal to radial lines of the axis of body 13. In the deployed position, the inner ends of paddles 19 are spaced to define an axial circular passage for closely receiving tubular members being lowered through wellhead protector 11, such as a drill string. When in the deployed position of FIG. 1, paddles 19 will centralize and maintain the drill string centered relative to body 13 so as to avoid damaging contact with the bore of the wellhead housing located below. When contacted by a member larger than the circular passage, such as a drill bit, paddles 19 will pivot toward the retracted position of FIG. 8 to allow the passage of the larger diameter tools.

Figure 8:
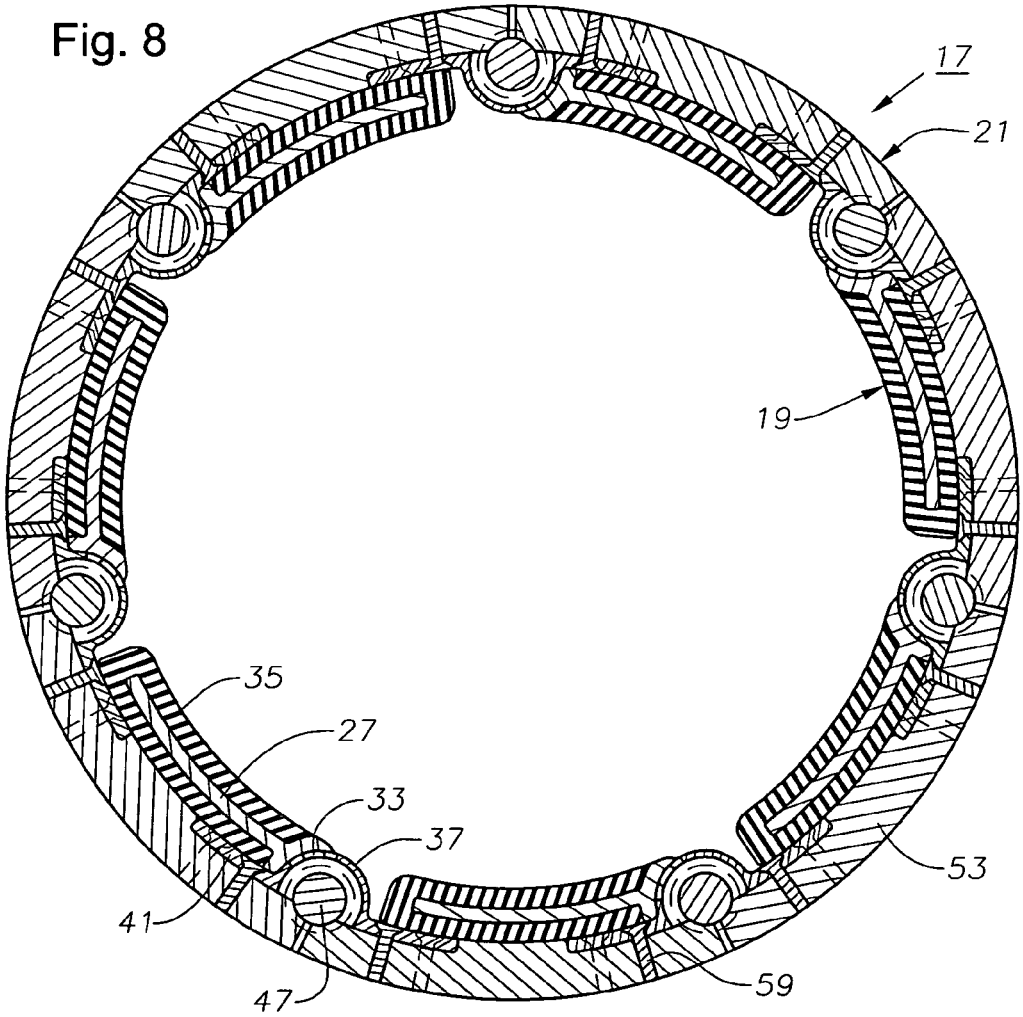
FIG. 8 is a sectional view of the centralizer of FIG. 2, taken along the line 8—8 of FIG. 2 and showing the centralizer in a retracted position.

Paddles 19 are mounted to a ring 21 that extends around an inner diameter portion of bore 14 of body 13. Ring 21 locates within an annular groove 23 that is formed in an annular recess 25 within bore 14. The engagement of ring 21 with groove 23 prevents upward and downward movement of centralizer 17. Recess 25 has a greater axial dimension than the axial dimension of centralizer 17 to accommodate paddles 19 while in the fully retracted position. The radial depth of recess 25 is preferably approximately the thickness of each paddle 19 so that centralizer 17 fits flush in recess 25 while retracted to provide a full bore passage. The inner diameter of centralizer 17 while in the retracted position of FIG. 8 is substantially the same as the diameter of bore 14 above and below recess 25. Bore 14 is preferably the nominal inner diameter of the riser string and wellhead housing bore. Each paddle 19 is curved at generally the radius of recess 25 for fitting flush within recess 25.

Figure 4:
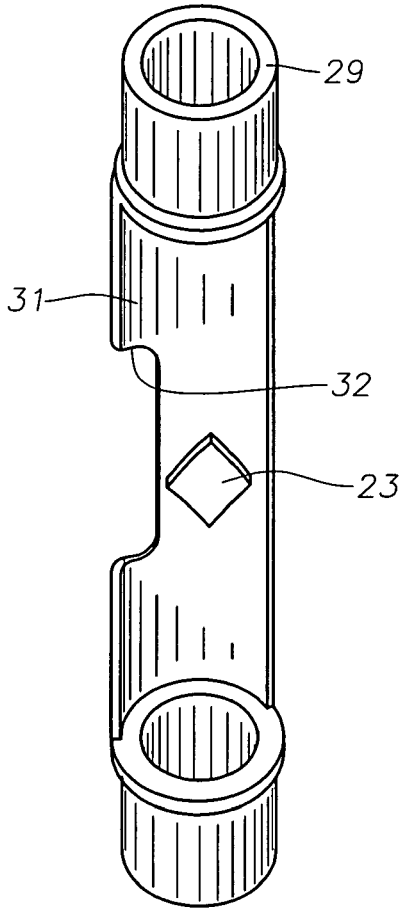
FIG. 4 is a perspective view of a hub assembly for the paddle assembly of FIG. 3, with the paddle not being shown.
Figure 6:
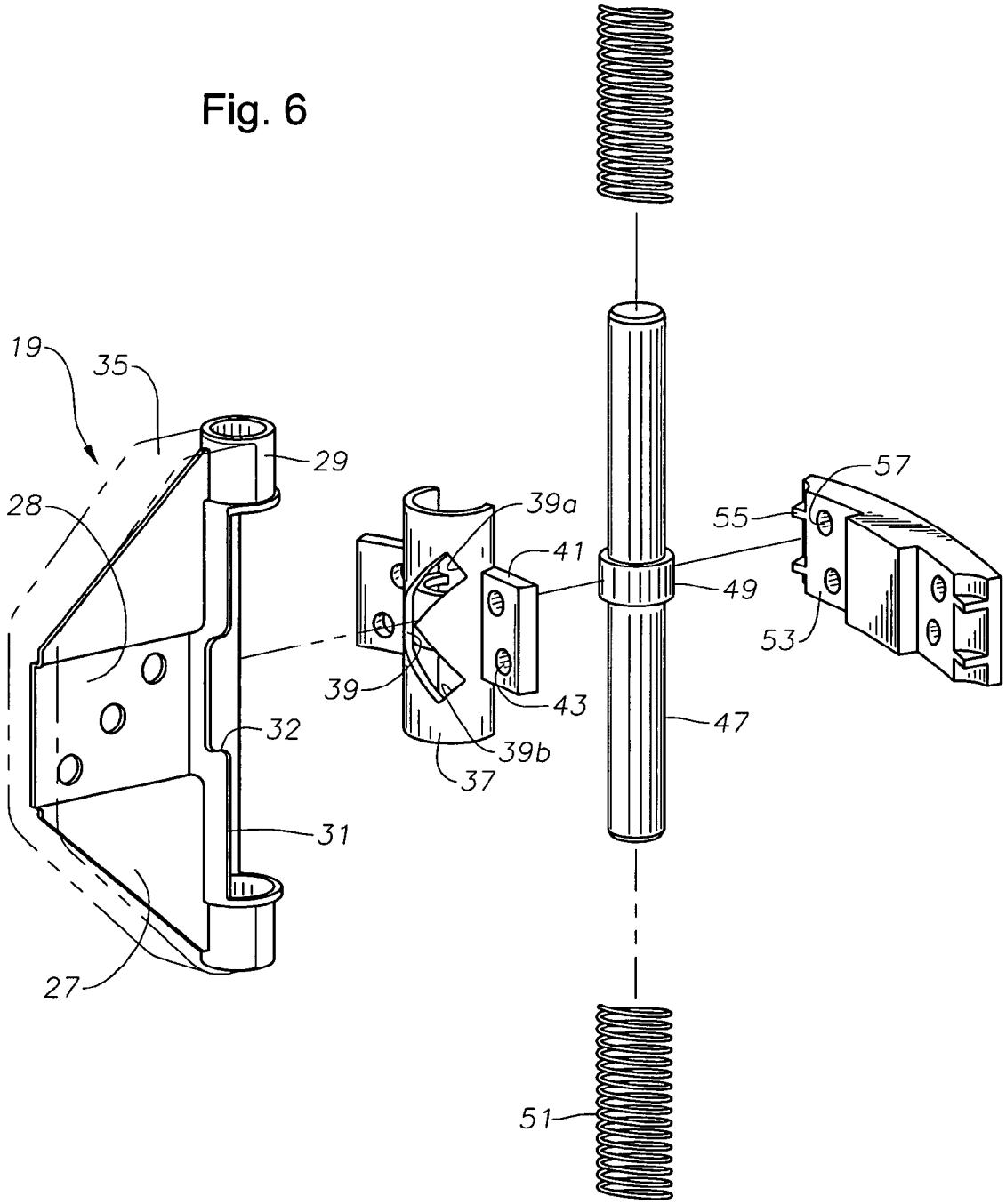
FIG. 6 is an exploded view of the components of the paddle assembly of FIG. 3.

Referring to FIG. 6, each paddle 19 has an internal rigid, preferably metal, stiffener plate 27 that has approximately the same configuration as paddle 19. Stiffener plate 27 curves from its inner edge to its outer edge and has a central recessed area 28 extending from its inner edge to its outer edge. A pair of circular sockets 29 is integrally formed on an outer edge of stiffener plate 27. Sockets 29 are cylindrical coaxial tubular members that are spaced apart from each other and have open upper and lower ends. An intermediate section 31 is integrally formed on the outer edge of stiffener plate 27 between sockets 29. As shown in FIG. 4, intermediate section 31 is partially cylindrical and has a rectangular notch 32 formed on one side that aligns with central recessed area 28 on stiffener plate 27 (not shown in FIG. 4). Intermediate section 31 also has a diamond-shaped cam 33 located on its concave or outer side. Cam 33 faces radially outward while paddles 19 are in the deployed position and protrudes slightly from the concave surface of intermediate section 31.

Figure 3:
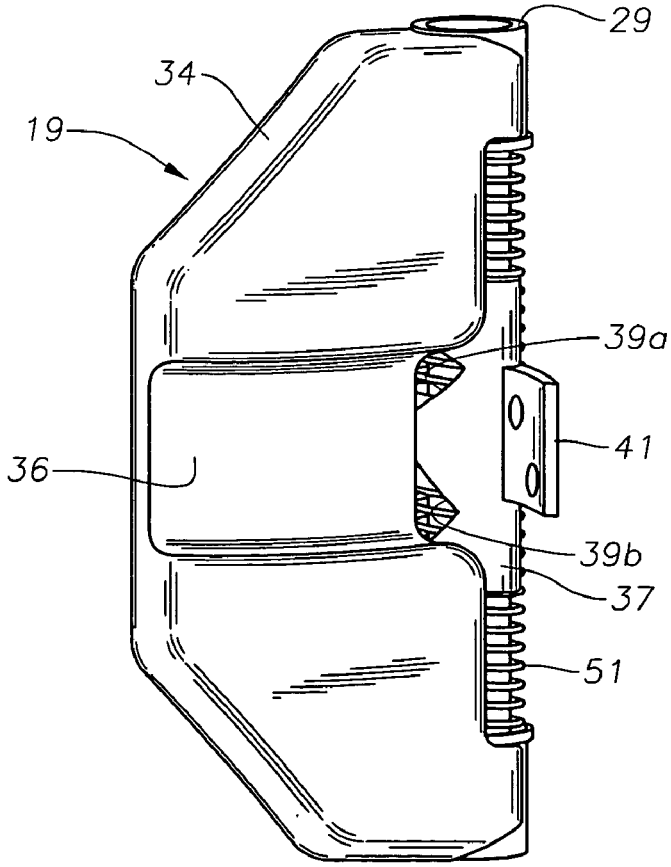
FIG. 3 is a perspective view of one of the paddle assemblies of the centralizer of FIG. 2.

Referring to FIG. 3, an elastomeric jacket 35 is molded over stiffener plate 27 and to the inner sides of intermediate section 31 and sockets 29. Jacket 35 has a recessed area 36 that is central and located over recessed area 28 of plate 27 (FIG. 6). Jacket 35 has inclined upper and lower edges 34 that converge toward each other and intersect the inner portion of jacket 35.

Figure 7:
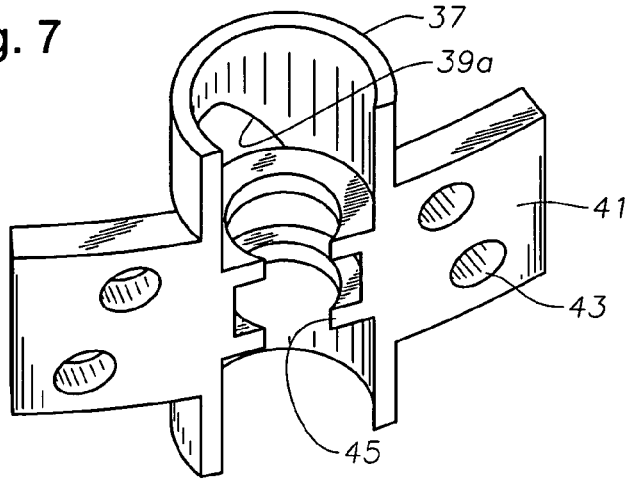
FIG. 7 is a perspective view of the outer side of the hub shown as one of the elements in FIG. 6.

Referring again to FIG. 6 as well as FIGS. 3 and 7, a hub assembly couples to intermediate section 31. The hub assembly includes a central semi-cylindrical hub 37. Hub 37 extends approximately 180° and has its convex side slidingly engaging the concave side of intermediate section 31. Hub 37 has a cam slot 39 to receive cam 33 (FIG. 4). Cam slot 39 has two legs 39*a* and 39*b*. Leg 39*a* inclines generally upward and leg 39*b* inclines generally downward. Legs 39*a* and 39*b* are perpendicular to each other and join each other to form a tilted "L" configuration. While paddles 19 are in the deployed position, cam 33 is located at the junction of legs 39*a* and 39*b*. When paddle 19 moves downward relative to hub 37, cam 33 moves from the junction of legs 39*a* and 39*b* downward into leg 39*b*. In doing so, the engagement of cam 33 in leg 39*b* causes paddle 19 to rotate counterclockwise as viewed from above. Similarly, if paddle 19 moves upward relative to hub 37, cam 33 will move from the junction of legs 39*a* and 39*b* upward into leg 39*a*, causing paddle 19 to rotate in the same direction.

Two brackets or fastener plates 41 are integrally joined to hub 37 and extend circumferentially from opposite sides. Brackets 41 are curved at a radius equal to the radius of ring 21 (FIG. 1). Each bracket 41 has a pair of holes 43. The outer side of hub 37 is shown in FIG. 7. Hub 37 is semi-cylindrical, extending slightly more than 180°. A pair of axially spaced-apart collars 45 is on the outer side between its upper and lower ends. Collars 45 are semi-circular ledges or ribs.

Figure 5:
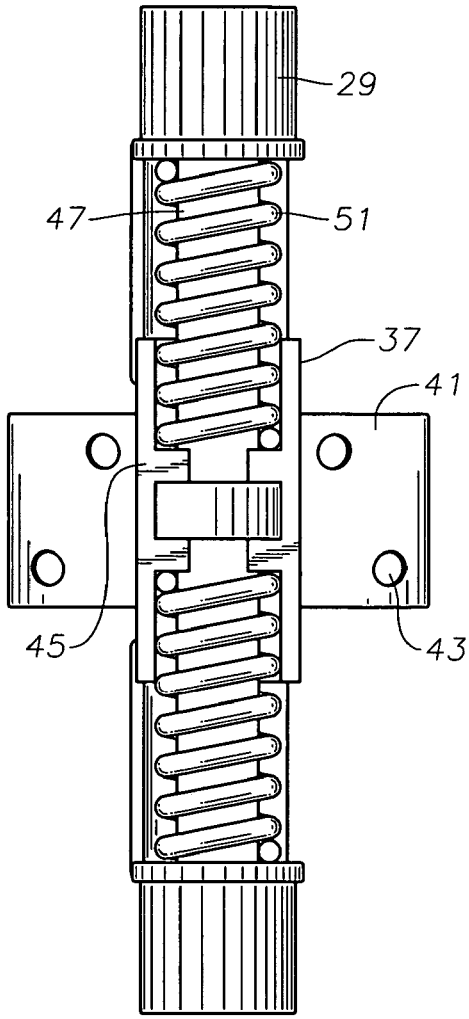
FIG. 5 is an outer side elevational view of the paddle assembly of FIG. 3.

As shown in FIG. 6, a rod 47 mates with hub 37. Rod 47 has an annular enlarged band 49 equidistant from its upper and lower ends. Band 49 is cylindrical and locates between collars 45 (FIG. 7) to prevent axial movement of rod 47 relative to hub 37. The upper end of rod 49 extends into sliding rotating engagement with the upper socket 29, while the lower end of rod 47 extends into sliding and rotating engagement with the lower socket 29. A pair of coil springs 51 fit over rod 47. As shown in FIG. 5, each coil spring 51 has one end that abuts one of the sockets 29 and another end that abuts one of the collars 45 (FIG. 7). Springs 51 are the same length to bias paddle 19 to the deployed position, wherein cam 33 (FIG. 4) locates at the intersection of legs 39*a* and 39*b* (FIG. 6).

Referring still to FIG. 6, ring 21 is made up of a plurality of ring segments 53, each segment 53 being a portion of a circle. Each segment 53 has collars 55 on opposite ends, which are partially circular members that extend about 90 degrees. Collars 55 align with collars 55 of an adjacent ring segment 53 and with collars 45 (FIG. 7) to form a 360 degree circular set of collars to trap band 49 of rod 47 between them. A plurality of holes 57 are formed in each end of ring segment 53 for aligning with one of the brackets 41. Screws 59 (FIG. 8) extend through holes 43 and 57 to not only secure hubs 37 to ring segment 53 but also to connect each ring segment 53 to adjacent ring segments 53. Each hub 37 is thus located at the junction of one of the ring segments 53 with an adjacent ring segment 53 as illustrated in FIG. 8.

In operation, centralizer 17 will be normally in the deployed position of FIG. 1. If a drill string or other type of downhole tool is being lowered through centralizer 17, the lower end will likely be of larger diameter than the cylindrical opening defined by the inner ends of paddles 19. For example, the lower end may comprise a drill bit that has a diameter considerably larger than the circular opening. The drill bit will contact the upper inclined sides 34 of each paddle 19, causing each paddle 19 to begin moving downward. Rods 47 and hubs 37 remain stationary however. As a result, cam 33 (FIG. 4) of each paddle 19 will move down leg 39*b* (FIG. 6) of hub 37. The inclination of leg 39*b* causes paddle 19 to rotate toward the retracted position shown in FIG. 8. The inner ends of paddles 19 slidingly engage the drill bit as it passes through. If the object passing through is sufficiently large, paddles 19 will rotate to the fully retracted position where they are flush with bore 14 (FIG. 1) of body 13. When fully retracted, recess 36 of each paddle 19 will fit over ring 21. Recess 36 has a curvature or radius that matches the inner diameter of ring 31 to accommodate this retracting movement. While rotating, intermediate section 31 and its sockets 29 move downward with the paddle 19. This causes the upper spring 51 to compress more while the lower spring 51 expands more.

Once the object, such as the drill bit, has passed through centralizer 17, paddles 19 spring back inward toward the deployed position. If the drill pipe is sufficiently small, paddles 19 may extend to the fully deployed position shown in FIG. 1. Paddles 19 will thus guide the drill pipe and the drill bit, maintaining them centralized along the axis of the wellhead located below to avoid contact with the sides of the bore of the wellhead.

As the drill string continues downward, any enlarged diameter portions of the drill string will cause centralizer 17 to again deflect toward the retracted position. For example, most drill pipe has upset tool joints or connectors at their ends that are of larger diameter than the remaining portion of the drill pipe. These tool joints would likely contact paddles 19 and push them downward, causing them to rotate sufficiently to allow the larger diameter portions to pass through centralizer 17.

When pulling the drilling string upward, the reverse occurs. The enlarged diameter portions of the drill string will contact the lower inclined edges 34 of paddles 19, pushing paddles 19 upward. This causes cam 33 (FIG. 4) to slide upward along upper leg 39*a* of each slot 39. Upper leg 39*a* inclines in the same direction as lower leg 39*b*, thus causes paddles 19 to rotate about hub 37 toward the retracted position.

The invention has significant advantages. The centralizer prevents contact of a drill string or other tools with interior surfaces of well components, avoid damage to sealing surfaces. Unlike wear bushings, the centralizer does not have to be retrieved before running the component that will seal within the wellhead, such as a casing hanger or tubing hanger. The centralizer operates automatically when contacted by a drill string or tool, and needs no hydraulic power to shift between open and restricted positions. The centralizer protects the seal surface located below it against contact with casing or tubing being run.

While the invention has been shown in only one of its forms, it should be apparent to those skilled in the art that it is not so limited, but is susceptible to various changes without departing from the scope of the invention. The cam and slot of the preferred embodiment could be reversed with the cam being on the stationary member and the slot on the movable member. As another embodiment, the centralizer could comprise a member that has an upward facing conical portion and a downward facing conical portion, each conical portion having vertical slots. The junction between the conical portions would be radially expansible when contacted by a well tool. Alternately, the centralizing members could be pivotally mounted about horizontal axes rather than vertical.

The invention claimed is:

1. An apparatus for centralizing a well tool, comprising:

a tubular body having an axis and a passage extending therethrough along the axis;

a centralizer mounted to the tubular body around the passage, the centralizer being movable between a restricted position and an unrestricted position in response to contact with a well tool moving through the passage; and at least one spring that urges at least one centralizing member to the restricted position.

2. The apparatus according to claim 1, wherein while in the restricted position, the centralizer defines an inner diameter less than an inner diameter of the passage and while in the unrestricted position, defines an inner diameter substantially equal to the inner diameter of the passage.

3. The apparatus according to claim 1, wherein the at least one centralizing member comprises a plurality of centralizing members, each of the centralizing members being rotatable about an axis parallel to the axis of the tubular body when moving between the restricted and unrestricted positions.

4. The apparatus according to claim 1, wherein the passage of the tubular body has an annular recess, and wherein the centralizer locates substantially entirely within the recess while in the unrestricted position.

5. The apparatus according to claim 1, wherein:

the passage of the tubular body has an annular recess;

the at least one centralizing member comprises a plurality of centralizing members, each centralizing member having an outer end mounted within the recess for rotation about an axis that is parallel to the axis of the tubular body; and while in the unrestricted position, the centralizing members are substantially wholly located within the recess.

6. The apparatus according to claim 1, further comprising:

a plurality of centralizing members mounted in the passage for rotation about an axis that is parallel to the axis of the tubular body; and each of the centralizing members having a configuration in the shape of a paddle that is curved, when viewed in a cross-section perpendicular to the axis, at a radius that is substantially equal to a radius of the passage.

7. An apparatus for centralizing a well tool, comprising:

a tubular body having an axis and a passage extending therethrough along the axis;

a plurality of centralizing members having inner and outer ends; and a plurality of axially extending hinge assemblies, each of the hinge assemblies being mounted to the tubular body in a circular array around a circumference of the passage, the outer end of each of the centralizing members being mounted to one of the hinge assemblies for rotation about the hinge assembly.

8. The apparatus according to claim 7, wherein each of the centralizing members is rotatable about one of the hinge assemblies from a restricted position with the inner ends located radially inward from the outer ends to an unrestricted position wherein the inner ends are substantially at the same radial distance as the outer ends.

9. The apparatus according to claim 7, wherein each of the hinge assemblies has a spring that urges each of the centralizing members to rotate to a restricted position wherein the inner ends of the centralizing members are closer to the axis of the tubular body than the outer ends.

10. The apparatus according to claim 7, wherein each of the hinge assemblies comprises:

a first hinge member;

a second hinge member located in engagement with and being rotatable relative to the first hinge member, each of the centralizing members being mounted to the second hinge member for rotation therewith; and a cam and slot arrangement formed between the first and second hinge members, so that an axially directed force on the each of the centralizers causes the second hinge members to rotate.

11. The apparatus according to claim 7, wherein each of the hinge assemblies comprises:

a first hinge member stationarily mounted to the tubular body;

a second hinge member located in engagement with and being rotatable relative to the first hinge member, each of the centralizing members being mounted to the second hinge member for rotation therewith;

a cam and a slot formed between the first and second hinge members, the slot having a neutral position, an upper inclined portion extending upward from the neutral position, and a lower inclined portion extending downward from the neutral position, the cam being located in the slot such that a downward force on each of the centralizers causes the cams to locate within the upper inclined portions and the centralizers to rotate, and an upward force on the each of the centralizers causes the cams to locate within the lower inclined portions and the centralizers to rotate; and at least one spring in cooperative engagement with the first and second hinge members to urge the cams to locate in the neutral position.

12. The apparatus according to claim 7, wherein the passage of the tubular body has an annular recess, and wherein the centralizing members locate substantially flush within the recess while in the unrestricted position.

13. The apparatus according to claim 7, wherein each of the centralizing members comprises a paddle that is curved, when viewed in a cross-section perpendicular to the axis, at a radius that is substantially equal to a radius of the passage.

14. An apparatus for centralizing a well tool, comprising:

a tubular body having an axis and a passage extending therethrough along the axis for receiving a well tool;

a plurality of centralizing members having inner and outer ends;

a plurality of axially extending stationary hinge members mounted to the tubular body in a circular array around a circumference of the passage;

the outer end of each of the centralizing members being rotatably mounted to one of the stationary hinge members for pivotal rotation of the inner end to a restricted position closer toward the axis and an unrestricted position farther away from the axis;

a cam and a slot formed between the outer end of each of the centralizing members and the stationary hinge member, each of the slots having an upward inclined portion, a downward inclined portion, and a neutral position located between the upward and downward inclined portions, the centralizing members being in the restricted position while the cam and the slot are in the neutral position; and at least one spring in cooperative engagement with the outer end of each of the centralizing members and the stationary hinge members for urging the cam and the slot to the neutral position.

15. The apparatus according to claim 14, wherein:

an axial extent of the outer end of each of the centralizing members is greater than an axial extent of the inner end of each of the centralizing members;

each of the centralizing members has an upper edge and a lower edge; and an inner portion of each of the upper and lower edges inclines relative to a plane perpendicular to the axis of the tubular body.

16. An method for centralizing a well tool, within a conduit of a well, comprising:

(a) mounting a centralizer to a tubular body around a passage of the tubular body, and biasing the centralizer members to a restricted position that defines an inner diameter less than an inner diameter of the passage;

(b) mounting the tubular body to the conduit; and (c) lowering the well tool through the passage and the conduit, contacting the centralizer with the well tool, the contact causing the centralizer to move from the restricted position to allow the well tool to pass.

17. The method according to claim 16, wherein step (c) further comprises biasing inner portions of the centralizer slidingly against the well tool as the well tool passes through the centralizer.

18. The method according to claim 16, wherein step (a) comprises providing the centralizer with a plurality of centralizing members, and pivotally mounting an outer end of each of the centralizing members to the tubular body.

19. The method according to claim 16, wherein:

step (a) comprises providing the centralizer with a plurality of pivotally mounted centralizing members; and step (c) comprises pivoting each of the centralizing members about an axis that is parallel to an axis of the passage.

20. The method according to claim 16, wherein step (a) comprises providing the centralizer with an unrestricted position wherein the centralizer circumscribes an inner diameter substantially equal to an inner diameter of the passage.

* * * * *